United States Patent [19]

Hammer et al.

[11] Patent Number: 5,034,096

[45] Date of Patent: Jul. 23, 1991

[54] PROCESS FOR BLEACHING AND DELIGNIFYING CELLULOSE-CONTAINING PRODUCTS

[75] Inventors: Benedikt Hammer; Horst Michaud; Stefan Weiss, all of Trostberg, Fed. Rep. of Germany

[73] Assignee: SKW Trostberg Aktiengesellschaft, Trostberg, Fed. Rep. of Germany

[21] Appl. No.: 939,562

[22] Filed: Dec. 9, 1986

[30] Foreign Application Priority Data

Dec. 16, 1985 [DE] Fed. Rep. of Germany ..... 3544398

[51] Int. Cl.[5] ..... D21C 3/00

[52] U.S. Cl. ..... 162/65; 162/76; 162/78; 162/79; 162/80; 162/90

[58] Field of Search ..... 162/78, 76, 65, 80, 162/90, 79

[56] References Cited

U.S. PATENT DOCUMENTS

| | | | |
|---|---|---|---|
| 4,025,453 | 5/1977 | Kravetz et al. | 252/102 |
| 4,158,595 | 6/1979 | Rave | 162/146 X |
| 4,426,466 | 1/1984 | Schwartz | 162/164.3 X |

FOREIGN PATENT DOCUMENTS

| | | |
|---|---|---|
| 0148712 | 7/1985 | European Pat. Off. . |
| 2560898 | 9/1985 | France . |

*Primary Examiner*—David A. Simmons
*Assistant Examiner*—Thi Dang
*Attorney, Agent, or Firm*—Felfe & Lynch

[57] ABSTRACT

The present invention provides a process for bleaching and delignifying cellulose-containing products with peroxides and/or oxygen and/or ozone, wherein there is additionally used 0.01 to 2.5% by weight of cyanamide and/or cyanamide salts, referred to the dry weight of the cellulose.

18 Claims, No Drawings

PROCESS FOR BLEACHING AND DELIGNIFYING CELLULOSE-CONTAINING PRODUCTS

The present invention is concerned with a process for bleaching and delignifying cellulose-containing products, for example cellulose, wood pulp, high-yield pulp and semi-chemical cellulose, with peroxides and/or oxygen and/or ozone as bleaching agent.

For obtaining cellulose from wood, reeds, straw, bagasse and the like plant materials, these raw materials are subjected to a digestion process (sulphite or sulphate process). After the digestion or breakdown, the cellulose is worked up by washing and bleaching. The bleaching serves, in the first place, to lighten the color of the cellulose and to remove a large part of the lignin still present.

The method still largely used for delignifying and bleaching cellulose is the treatment with chlorine and chlorine dioxide or hypochlorite. As a rule, the standard bleach consists of three stages in which, in the first stage, chlorination of the residual lignin with chlorine water is carried out at a pH of 1 to 2. In the second stage, the chlorolignins are then washed out with water or aqueous sodium hydroxide solution while, in the third stage, the cellulose is subjected to an oxidising and lightening bleach with hypochlorite at a pH of $>6$. The bleaching with chlorine dioxide, which is especially gentle but expensive, can either be in addition to the standard bleaching or can take place instead of the hypochlorite treatment.

A disadvantage of this process is the great impairment of the environment which, in particular, is brought about by the chlorination because a large amount of chlorolignins is hereby produced which result in a great loading of the waste water.

A method which results in a substantially reduced impairment of the environment is bleaching with peroxides, such as sodium peroxide or hydrogen peroxide, or with oxygen or ozone. Similarly to the chlorine dioxide treatment, the peroxide bleaching is employed in addition to the standard bleaching stages in order to produce a very white cellulose. Furthermore, these compounds can also be used as the sole bleaching agents, especially in the case of semi-bleaching. A disadvantage of this process is the limited bleaching action of the peroxides or of oxygen so that the quality of a highly bleached cellulose cannot be achieved economically. This is an important reason why this bleaching process still has not achieved a wider use.

Therefore, it is an object of the present invention to provide a process for bleaching and delignifying cellulose-containing products with peroxides and/or oxygen and/or ozone which does not display the disadvantages of the previously known processes but which rather, in spite of good environmental compatibility, possesses an excellent bleaching action.

Thus, according to the present invention, there is provided a process for bleaching and delignifying cellulose-containing products with peroxides and/or oxygen and/or ozone, wherein there is additionally used 0.01 to 2.5% by weight of cyanamide and/or cyanamide salts, referred to the dry weight of the cellulose.

Thus, we have, surprisingly, ascertained that, by means of the addition of cyanamide and/or of cyanamide salts, substantially higher degrees of whiteness can be achieved than without cyanamide.

Simultaneously with the improved bleaching action, there also occurs a substantially higher degree of delignification of the cellulose. Furthermore, by means of the addition of cyanamide, a substantially smaller decomposition of the cellulose is ascertained, which has the same meaning as an especially careful treatment of the cellulose fibers and was also not foreseeable.

In the case of the process according to the present invention, as is usual in the case of peroxide bleaching, hydrogen peroxide or sodium peroxide are used in an amount of from 0.2 to 2.5% by weight, referred to the dry content of the cellulose, the hydrogen peroxide preferably being used in the form of a 30 to 35% aqueous solution.

The amount of cyanamide or cyanamide salt to be used in the process according to the present invention depends essentially upon the peroxide, oxygen or ozone content and amounts to 0.01 to 2.5% by weight, preferably 0.1 to 1.0% by weight, referred to the dry content of the cellulose.

In the case of less than 0.01% by weight, the improvement due to the cyanamide is practically no longer ascertainable, whereas in the case of exceeding the upper limit of 2.5% by weight, no substantial improvement is to be achieved so that it is uneconomic. Thus, referred to the peroxide content, there is provided a mole ratio of cyanamide:peroxide of 0.1 to 0.7.

The concentration of the cyanamide or cyanamide salt used can be varied within wide limits. Cyanamide itself can be used not only as solid material but also in the form of an aqueous solution, for example in the form of a 10 to 60% aqueous solution.

As cyanamide salts, there are preferably used those with an alkaline reaction, for example sodium hydrogen cyanamide, calcium cyanamide or magnesium cyanamide, because in this way, there can simultaneously be carried out a certain alkaline pH value adjustment. The alkaline earth metal ions calcium and magnesium simultaneously also have a stabilising effect on the hydrogen peroxide solution, as is explained hereinafter in more detail.

A decomposition of the peroxide during the bleaching procedure is highly undesirable since not only is the bleaching effect reduced but, at the same time, a marked damaging of the cellulose fibres also takes place. In order to avoid this decomposition, stabilisers, for example waterglass, or complex formers, for example sodium ethylenediamine-tetraacetic acid, are also added to the cellulose suspension in an amount of from 0.1 to 5% by weight, referred to the dry content of the cellulose. However, as a rule, such an addition can be omitted if the heavy metal salts have been removed by washing the cellulose prior to the bleaching.

Apart from waterglass, the cellulose suspension can also be mixed with metal salts which, besides a stabilising action, also manifest an activating action on the peroxide. Here, too, it is recommended to use amounts of from 0.1 to 5% by weight, referred to the dry weight of the cellulose. As metal salts, it is preferred to use the aluminium salts or alkaline earth metal salts, such as magnesium, calcium and barium salts, these metals preferably being used in the form of their oxides, hydroxides, sulphates, chlorides or nitrates because of the low costs thereof.

With regard to the reaction conditions, we have found that the optimum pH value is from 4.0 to 13.0 and preferably from 5.0 to 10.0 and the preferred temperature is from 20° to 150° C. In the case of these conditions, it is, in general, possible to achieve the best results, i.e. high degree of whiteness with a relatively short period of treatment and under gentle conditions, the exact process parameters thereby depending upon the nature and pre-treatment of the cellulose used.

In the case of a preferred embodiment of the process according to the present invention, the cellulose suspension, which generally has a solids content of from 3 to 20% by weight, is adjusted with the usual acidic or basic reacting substances to the desired pH value and subsequently the stabilisers or activators, such as waterglass or metal salts, are added thereto. There then follows the addition of peroxide, oxygen or ozone and of the cyanamide. After the bleaching at a particular temperature, which, depending upon the nature of the desired degree of whiteness, can last from 15 minutes to 4 hours, there follows the working up of the cellulose. For this purpose, the cellulose suspension is adjusted to a pH value of from 5 to 7 and subsequently dehydrated or dried.

With the help of the process according to the present invention, it is possible to increase the degree of whiteness, i.e. the bleaching effect, of unbleached cellulose by up to 50% in comparison with a purely peroxide bleach, whereas the corresponding increase in the case of cellulose which has already been pre-bleached is still 20 to 30%.

The degree of delignification, which is also defined by the kappa value (see the following Examples), is, in the case of the peroxide or oxygen bleach with cyanamide, about 50% more favorable than in the case of a bleach without cyanamide. Finally, the viscosity, which is a measure of the degree of polymerisation of the cellulose and thus a direct indication of a damage (decomposition) of the cellulose fibers, is, in the case of the process according to the present invention, markedly better than in the case of the previously known processes.

In principle, the process according to the present invention can be applied to all cellulose-containing products, for example sulphite and sulphate cellulose, CTMP cellulose, conifer cellulose and wood pulp, in all bleaching stages, such as pre- or post-bleaching. It is also possible to combine various bleaching stages, for example peroxide and chlorine dioxide bleaching, if, for any reason, this appears to be advantageous.

The following Examples are given for the purpose of illustrating the present invention.

DETERMINATIONS

Degree of whiteness

Irradiation of a specially prepared cellulose sample with light and photoelectric measurement of the reflectivity. The reflection was carried out with a Gardner degree of whiteness measurement apparatus (measurement geometry 45°). The reflection of magnesium oxide corresponds to a degree of whiteness of 100. In the following Examples, there is always given the relative degree of whiteness (Δ degree of whiteness=degree of whiteness with cyanamide−degree of whiteness without cyanamide).

Kappa number

This characteristic is a measure of the lignin content in the cellulose: The determination takes place according to ISO 302. In the following Examples, there are again given the relative values (Δ kappa=kappa with cyanamide−kappa without cyanamide).

Viscosity

This is a measure of the degree of polymerisation of the cellulose. The determination takes place according to CCA 16 (Zellcheming IV/30/62). In the following Examples, there are only given the relative viscosities (Δ viscosity=viscosity with cyanamide−viscosity without cyanamide), the unit being m Pa. sec.

In the following Examples, the amounts of cyanamide are given in percentages by weight and refer, if not stated otherwise, to the dry content of the cellulose.

EXAMPLE 1 (COMPARATIVE)

85 g. of unbleached magnefite conifer cellulose (dry weight about 10 g.) were first mixed with 0.5 g. of 10% aqueous sodium hydroxide solution and 0.5 g. commercially available waterglass and subsequently with 0.44 g. 35% hydrogen peroxide. Bleaching took place at 60° C. for about 2 hours. The pH value of the suspension was 10.0 before bleaching and 8.1 thereafter. The cellulose suspension was diluted with water to 500 ml., the pH value was adjusted to 6.0 with sulphuric acid and the cellulose was dried.

EXAMPLE 2

Working was as in Example 1 but, after the addition of the hydrogen peroxide, there were also added 20 mg. cyanamide in the form of 0.2 g. of a 10% cyanamide solution (about 0.2% by weight, referred to the dry content of the cellulose). The reaction conditions and working up were as in Example 1.

EXAMPLE 3

Working was as in Example 2 except that there were added 50 mg. of solid cyanamide (0.5% by weight).

The results obtained in Examples 1 to 3 are summarised in the following Table I:

TABLE I

| Example No. | cyanamide (wt. %) | Δ degree of whiteness | Δ kappa | Δ viscosity (m Pa · sec) |
|---|---|---|---|---|
| 1 | 0 | — | — | — |
| 2 | 0.2 | 1.6 | n.d. | n.d. |
| 3 | 0.5 | 4.0 | −4.3 | 42 |

n.d. = not determined

EXAMPLE 4 (COMPARATIVE)

50 g. unbleached magnefite conifer cellulose (10 g. dry weight) were mixed with 2 g. 10% aqueous sodium hydroxide solution, 0.5 g. waterglass and 0.44 g. 35% hydrogen peroxide, placed in the glass insert of an autoclave and heated for 1 hour at 120° C. with 20 ml. water. After the bleach, the pH value was 8.3 and residual peroxide could not be detected with titanyl sulphate. Working up took place analogously to Example 1.

EXAMPLE 5

Working was as in Example 4 but, after the addition of the hydrogen peroxide, there was also added 0.5 g. of a 10% aqueous cyanamide solution (0.5% by weight). Working up took place as in Example 1.

The results obtained in Examples 4 and 5 are summarized in the following Table II:

TABLE II

| Example No. | cyanamide (wt. %) | Δdegree of whiteness | Δkappa | Δviscosity (m Pa.sec) |
|---|---|---|---|---|
| 4 | 0 | — | — | — |
| 5 | 0.5 | 2.0 | −6.3 | 1.6 |

EXAMPLE 6 (COMPARATIVE)

308 g. magnefite conifer cellulose, which had been chlorinated with a mixture of chlorine/chlorine dioxide (90:10 v/v) and subsequently subjected to an alkaline extraction (pH value of the cellulose 9.7), were mixed with 2.64 g. 30% hydrogen peroxide and bleached at 60° C. Samples were taken after 15, 30, 60 and 120 minutes and worked up. After the bleaching the pH value was 6.2–6.4.

EXAMPLE 7

Working was as in Example 6 but with an addition of 4.0 g. of a 10% aqueous cyanamide solution (1% by weight).

The results obtained in Examples 6 and 7 are summarised in the following Table III:

TABLE III

| Example No. | cyanamide (wt. %) | time (min.) | Δdegree of whiteness | Δkappa | Δviscosity (m Pa.sec) |
|---|---|---|---|---|---|
| 6/7 | 0/1.0 | 15 | 6.5 | n.d. | n.d. |
| | | 30 | 7.4 | n.d. | n.d. |
| | | 60 | 7.3 | −0.6 | n.d. |
| | | 120 | 7.2 | −0.7 | +17 |

EXAMPLE 8 (COMPARATIVE)

63 g. of an unbleached spruce CTMP material (10 g. dry weight) were mixed with 2.0 g. 10% aqueous sodium hydroxide solution, 0.2 g. waterglass and 0.44 g. 35% hydrogen peroxide and bleached for 2 hours at 60° C. The pH value was 12.7 before the bleaching and 10.3 thereafter. Working up was as in Example 1.

EXAMPLE 9

Working was analogous to Example 8 but with the addition of 0.5 g. of 10% cyanamide solution (0.5% by weight). The pH value was 11.6 before the bleaching and 10.5 thereafter.

The results obtained in Examples 8 and 9 are summarized in the following Table IV:

TABLE IV

| Example No. | cyanamide (wt. %) | Δdegree of whiteness | Δkappa |
|---|---|---|---|
| 8 | 0 | — | — |
| 9 | 0.5 | 4.8 | −5.7 |

EXAMPLE 10 (COMPARATIVE)

50 g. magnefite conifer cellulose (10 g. dry weight) were mixed with 6.0 g. 10% aqueous sodium hydroxide solution and 0.01 g. magnesium oxide, placed into an autoclave and pressurised to 5 bar oxygen. Bleaching took place at 85° C. for 30 minutes. The pH value before the bleaching was 11.8 and 11.4 thereafter. Working up took place as in Example 1.

EXAMPLE 11

Working was as in Example 10 but with the addition of 0.5 g. of a 10% aqueous cyanamide solution.

The results obtained in Example 10 and 11 are summarized in the following Table V:

TABLE V

| Example No. | cyanamide (wt. %) | Δdegree of whiteness |
|---|---|---|
| 10 | 0 | — |
| 11 | 0.5 | 2.5 |

EXAMPLE 12 (COMPARATIVE)

50 g. magnefite conifer cellulose (10 g. dry weight) were mixed with 0.1 g. aluminium sulphate, 30 g. chlorine dioxide water (1.2 wt. % chlorine dioxide referred to the dry weight of the cellulose) and 0.44 g. 35% hydrogen peroxide and bleached for 2 hours at 60° C. The pH value was 4.8 before the bleaching and 6.4 thereafter. Working up was in Example 1.

EXAMPLE 13

Working was as in Example 12 but with the addition of 0.5 g. of a 10% cyanamide solution (0.5% by weight).

The results obtained in Examples 12 and 13 are summarized in the following Table VI:

TABLE VI

| Example No. | cyanamide (wt. %) | Δdegree of whiteness | Δkappa |
|---|---|---|---|
| 12 | 0 | — | — |
| 13 | 0.5 | 1.5 | −5 |

EXAMPLE 14 (COMPARATIVE)

67 g. of a wood pulp from pinewood (10 g. dry weight) were mixed with 1.5 g. 10% aqueous sodium hydroxide solution, 0.5 g. waterglass and 0.43 g. 35% hydrogen peroxide and bleached for 2 hours at 40° C. The pH value was 10.9 before the bleaching and 9.1 thereafter. Working up took place as in Example 1.

EXAMPLE 15

Working was as in Example 14 but with the addition of 0.5 g. of a 10% cyanamide solution.

The results obtained in Examples 14 and 15 are summarized in the following Table VII:

TABLE VII

| Example No. | cyanamide (wt. %) | Δdegree of whiteness | Δkappa |
|---|---|---|---|
| 14 | 0 | — | — |
| 15 | 0.5 | 3.8 | −3 |

It will be understood that the specification and examples are illustrative but not limitative of the present invention and that other embodiments within the spirit and scope of the invention will suggest themselves to those skilled in the art.

We claim:

1. In a process for bleaching and delignifying a digested cellulose-containing product with a bleaching agent selected from the group consisting of peroxide, oxygen, ozone and a combination thereof, the improvement comprising: forming a cellulose suspension having a solids content of 3 to 20 wt. % of the digested cellulose-containing product in an aqueous medium, the suspension having a pH of 4 to 13; and bleaching the cellulose-containing product with the bleaching agent, said bleaching agent further comprising 0.01 to 2.5% by weight of cyanamide, a cyanamide salt or a combination thereof, referred to the dry weight of the cellulose.

2. The process of claim 1 wherein a peroxide stabilizer in an amount of 0.1 to 5 wt. %, referred to the dry content of the cellulose, is added to the cellulose suspension containing the bleaching agent.

3. The process of claim 2, wherein the peroxide stabilizer is a complex former.

4. The process of claim 3, wherein the complex former is sodium ethylenediamine-tetraacetate.

5. The process of claim 2, wherein the peroxide stabilizer is waterglass.

6. The process of claim 1 wherein the cyanamide salt is used, said cyanamide salt being selected from the group consisting of sodium hydrogen cyanamide, calcium cyanamide, and magnesium cyanamide.

7. The process of claim 6 wherein the cyanamide salt is used and is sodium hydrogen cyanamide.

8. The process of claim 6 wherein cyanamide salt is used and is calcium cyanamide.

9. The process of claim 6 wherein the bleaching is accomplished at a temperature of 20° to 150° C.

10. The process of claim 1 wherein a metal salt, in an amount of from 0.1 to 5 wt-% referred to the dry content of the cellulose, is added to the cellulose suspension containing the bleaching agent.

11. The process of claim 10, wherein the metal salt is an aluminum salt.

12. The process of claim 10, wherein the metal salt is an alkaline earth metal salt.

13. The process of claim 1, wherein the bleaching agent contains 0.1 to 1.0% by weight of cyanamide and/or a cyanamide salt.

14. The process of claim 1, wherein the bleaching agent is a peroxide and the mole ratio of cyanamide: peroxide is from 0.1 to 0.7.

15. The process of claim 1 wherein the cyanamide, cyanamide salt or combination thereof is used in the form of a 10 to 60% aqueous solution.

16. The process of claim 1, wherein the pH value of the cellulose suspension is adjusted before bleaching to 5.0 to 10.0.

17. The process of claim 1 wherein the reaction temperature during bleaching is from 20° to 150° C.

18. The process of claim 1 wherein cyanamide is used in the form of a 10 to 60% aqueous solution.

* * * * *